United States Patent [19]

Van den Bergh

[11] Patent Number: 4,905,597

[45] Date of Patent: Mar. 6, 1990

[54] METHOD AND APPARATUS FOR PIN FEEDING AND PRINTING CONTINUOUS FORMS

[75] Inventor: Marc F. Van den Bergh, Belsele, Belgium

[73] Assignee: Web Converting Equipment N.V., Sint-Niklaas, Belgium

[21] Appl. No.: 161,022

[22] Filed: Feb. 26, 1988

[30] Foreign Application Priority Data

Mar. 6, 1987 [BE] Belgium ..... 08700217

[51] Int. Cl.[4] ..... B41F 13/02; B41J 11/30

[52] U.S. Cl. ..... 101/217; 101/228; 226/6; 226/74; 400/577; 400/616.2; 400/618

[58] Field of Search ..... 400/577, 616, 616.1, 400/616.2, 616.3, 618; 101/224, 225, 226, 227, 228; 226/6, 74, 75, 76, 77, 195

[56] References Cited

U.S. PATENT DOCUMENTS

| | | | |
|---|---|---|---|
| 2,151,028 | 3/1939 | Hayward | 101/226 |
| 3,543,982 | 12/1970 | Sargent | 226/195 X |
| 3,797,389 | 3/1974 | Wolff | 101/228 |
| 4,095,731 | 6/1978 | Harding et al. | 226/195 X |
| 4,153,191 | 5/1979 | Bishop | 101/222 X |
| 4,328,749 | 5/1982 | Inouye et al. | 101/228 X |
| 4,512,256 | 4/1985 | Schriber et al. | 101/226 X |
| 4,742,772 | 5/1988 | Grose | 101/228 X |
| 4,751,879 | 6/1988 | Van Pelt | 101/228 |
| 4,775,087 | 10/1988 | Moser et al. | 101/228 X |

FOREIGN PATENT DOCUMENTS

| | | | |
|---|---|---|---|
| 229036 | 7/1987 | European Pat. Off. | 400/616.3 |
| 2617418 | 11/1976 | Fed. Rep. of Germany | 101/228 |
| 180865 | 9/1985 | Japan | 400/577 |
| 234962 | 10/1987 | Japan | 400/616.3 |

*Primary Examiner*—Clifford D. Crowder

*Attorney, Agent, or Firm*—Stevens, Davis, Miller & Mosher

[57] ABSTRACT

A strip provided adjacent the edges thereof with perforations is driven forwards during a printing operation by the cooperating printing and counter-pressure cylinders of an offset mechanism, and by two pairs of pin tractors, pins of which enter the somewhat larger perforations. When the cylinders release the strip, same is moved backwards by the pin tractors over a distance equal to the difference between the forward displacement and the length of a form. To position the strip before a new printing operation, those pins going through the perforations of the pin tractors are moved a little forwards until they lie anew frontwards in the perforations.

11 Claims, 2 Drawing Sheets

METHOD AND APPARATUS FOR PIN FEEDING AND PRINTING CONTINUOUS FORMS

BACKGROUND OF THE INVENTION

The invention relates to a method for printing continuous forms, according to which one brings a strip to be printed, which is provided adjacent both lengthwise edges thereof with round perforations, between a printing cylinder and a counter-pressure cylinder cooperating therewith of an offset printing mechanism which perform simultaneously, per printing operation, a revolution in opposite direction and which during a simultaneous revolution, firmly clamp the strip over part of said revolution and notably during the printing operation proper, and feed same forwards, and over another part of the revolution, release the strip, and during the release of said strip, by means of at least one pair of pin tractors, one of which is arranged respectively on both edges and which are provided with pins the base diameter of which is smaller than the diameter of the round perforations in said strip, one moves said strip backwards over a distance which is substantially equal to the difference between the forward displacement during said revolution and the length of a form to be printed.

With such a method, forms with various lengths may be printed.

In known methods of this kind, the printing is however inaccurate. The perforations in a strip of paper always are of necessity of a larger diameter than the pin base of the pin tractors, whereby the accurate positioning of the strip, immediately before being clamped between the printing cylinder and the counter-pressure cylinder is not possible.

Due to the strip of paper being moved backwards by the pins, said pins always come to lie against the perforation back, whereby thus when the strip is clamped back between the printing cylinder and the counterpressure cylinder, the pins can not drive the strip directly forward.

THE INVENTION

The invention has for object to obviate this drawback and to provide a method whereby the printing can occur very accurately.

For this purpose, after moving the strip backwards after a printing operation proper and before clamping the strip again between the printing cylinder and the counter-pressure cylinder for a following printing operation, one drives the pin tractors in such a way that those pins thereof which go through the strip perforations, move over a small distance in the forward direction, at least until said pins lie at the front, as considered along said displacement direction of the strip, in said perforations, and one drives the strip during the feeding movement thereof, both with the cylinders and with the pin tractors.

In a particular embodiment of the invention, the distance whereover the pins from the pin tractors which go through the perforations, are moved anew forwards after the displacement in the backward direction, is precisely equal to the difference between the perforation diameter in the strip and the base diameter of the pins of the pin tractors.

The invention further relates to a device which is particularly suitable for the working of the method according to one of the previous embodiments.

The invention thus pertains to a device for printing continuous forms on a strip which is provided along both lengthwise edges thereof, with round perforations, which device comprises an offset printing mechanism which is provided in turn notably with a printing cylinder and a facing counter-pressure cylinder cooperating therewith, and means to drive said cylinders in opposite direction, which cylinder and counter-pressure cylinder are so shaped that during a simultaneous revolution in opposite direction, they can clamp the strip therebetween during part of a revolution and notably during the printing operation proper, and thus move same forwards and release said strip during the remainder of the revolution, which device comprises at least one pair of pin tractors to drive said strip, one thereof being arranged respectively along each lengthwise strip edge, and which are provided with pins the base diameter of which is smaller than the diameter of the round perforations in said strip, and a number of said pins go through perforations, and means to drive the pin tractors and a control device which so controls the means for driving the pin tractors and the means for driving the cylinders, that after the cylinders have released the strip, the pin tractors move the strip in the backward direction over a distance which is substantially equal to the difference between said forward displacement before the releasing and the length of a form to be printed, the feature of said device lying in the control device being so designed that after the pin tractors have moved the strip in the backward direction and before the printing cylinder and counter-pressure cylinder clamp anew the strip for a following printing operation, the pin tractors so move that those pins which go through the strip perforations, are displaced over a small distance in the forward direction, at least until they lie frontwards, as considered in said displacement direction of the strip, in said perforations, and said control device so operates the means for driving the cylinders and the means for driving the pin tractors, that during clamping of the strip by the cylinders, said strip is being fed forwards by said cylinders as well as by said pin tractors.

With this device, a high accuracy can be obtained when printing.

In a particular embodiment of the invention, the printing device comprises a device for making round perforations adjacent both lengthwise strip edges.

The device for making round perforations preferably comprises a perforating mechanism, a smoothing-down mechanism on the feeding side of the perforating mechanism, and driving means to drive the strip on the discharge side of the perforating mechanism.

With this device, the strip is not stretched as the perforations are made and the lengthwise perforations on the strip edges may be obtained very accurately.

Other features and advantages of the invention will stand out from the following description of a method for printing continuous forms and of the device being used thereby according to the invention; this description is only given by way of example and does not limit the invention; the reference numerals pertain to the accompanying drawings.

DRAWINGS

In both figures, the same reference numerals pertain to the same elements.

DESCRIPTION OF A PREFERRED EMBODIMENT

Figure 1:
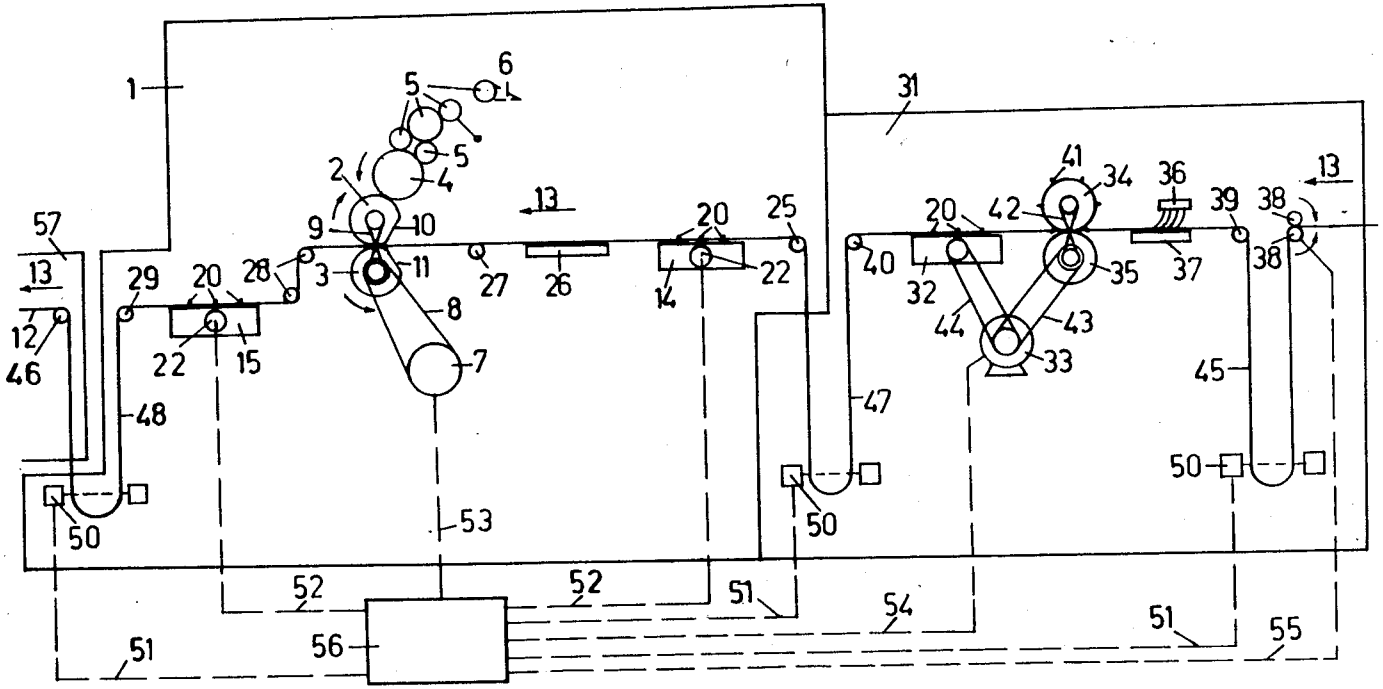
FIG. 1 is a diagrammatic side view of a device for printing continuous forms according to the invention.

The invention for the printing of continuous forms according to the figures comprises an offset printing mechanism of a known type which comprises in the conventional way, a frame 1 with a number of horizontal cylinders being supported therein, namely a printing cylinder 2, a counter-pressure cylinder 3 cooperating therewith, also called rubber-cloth cylinder, which is mounted underneath the printing cylinder 2, a plate cylinder 4 cooperating with the printing cylinder, which is mounted tangentially above the printing cylinder 2 for conveying an ink pattern to the printing cylinder 2, and a number of ink rollers 5 contacting one another, some of which also engage the plate cylinder 4, for conveying ink from an ink tank 6 to plate cylinder 4. The ink rollers 5 and plate cylinder 4 are driven in a known way which has not been shown for clearness' sake in the figures.

On frame 1 there is mounted an electric motor 7 which drives through a first chain transmission 8, the counter-pressure cylinder 3 and which drives through a second chain transmission 9 the printing cylinder 2, in such a way that both cylinders 2 and 3 rotate synchronously and in opposite direction.

The printing cylinder 2 and counter-pressure cylinder 3 each comprise a flattened portion 10,11 respectively. Said flattened portions come to lie facing one another by each revolution. As long as said portions 10 and 11 lie facing one another, the strip of paper 12 to be printed, fed between cylinders 2 and 3, is loose. A strip 12 lying between cylinders 2 and 3 is consequently driven during the major portion of a simultaneous revolution in opposite direction of said cylinders 2 and 3, in the forward direction as shown by arrow 13, whereby the printing cylinder 2 further conveys the ink pattern thereof to strip 12, but the strip is released during a shorter portion of said revolution corresponding to flattened portions 10,11.

The printing device further comprises two pairs of pin tractors 14 and 15, one pair 14 on the feed side and one pair 15 on the discharge side of cylinders 2 and 3. The pin tractors 14 and 15 are of a known type and will only be described hereinafter as far as required to make the invention clear. They comprise in the usual way, a housing 16 wherein two small wheels 17 and 18 are supported on either side, and an endless belt 19 which runs over the small wheels 17 and 18 and which is provided on the outer side thereof with round pins 20 the diameter of which at the top is smaller than the diameter at the base thereof.

The pin tractors from one and the same pair are driven through a common drive shaft 21 supported in frame 1, by a stepping motor 22. The pin tractors 14 or 15 of one pair are adjustable over the drive shaft 21, in such a way that the intermediate spacing thereof may be adapted to the width of strip 12.

Through one of the small wheels 17 goes axially a shaft 23 which is also supported in frame 1 and whereon a knob 24 is secured at one end. With said knob 24, a manual adjustment of the position of pins 20 is possible.

The strip of paper 12 is fed over a first guide roller 25, the pin tractors 14, a guide plate 26 and a second guide roller 27 to the offset printing mechanism 2-11, and it is discharged therefrom by means of two guide rollers 28, the pin tractors 15 and a guide roller 29.

The printing device further comprises a device for making round perforations 30 with a standard diameter, adjacent both edges of paper strip 12. The diameter of the perforations 30 is as usual larger by nearly 1 mm than the base diameter of pins 20.

The device for making the perforations comprises a frame 31 which is part of frame 1, whereon a pair of pin tractors 32 driven by a D.C. motor 33, similar to said pin tractors 14 and 15, a perforating mechanism 34-35, a brush 36, a support plate 37 and guide rollers 39 and 40 are mounted.

The perforating mechanism 34,35 comprises a cylinder 34 supported in frame 31 and provided with suitable projections to make the perforations 30, and a cylinder 35 cooperating therewith. Both cylinders 34 and 35 are driven through chain drives 42 and 43, in opposite direction and synchronously with one another by the motor 33, which also drives through a chain transmission 44, the pin tractor 32 synchronously with said perforating mechanism 34,35.

The strip 12 is fed to the above-described perforating device by means of two rollers 38 clamped against one another, the one of which is driven by a motor not shown in the figures. The strip 12 is unwound from a roll not shown in the figures and led between said rollers 38.

To prevent when perforating in the perforating device, that the strip 12 be irregularly stretched, a loop 45 is formed between said rollers 38 and said roller 39 from the perforating device.

Inside the perforating device, the strip is only driven by the pin tractors 32 and before the perforating mechanism 34,35,41, it is spread over the support plate 37 by the brush 36.

There is obtained in this way a very accurate perforation and consequently also an accurate drive during the printing.

As soon as by the simultaneous revolution thereof, the cylinders 2 and 3 from printing mechanism 2-8 clamp firmly the strip 12, said strip is fed forwards in said mechanism along the direction shown with arrow 13. Both pin tractors 14 and 15 drive said strip together in the same direction. The strip is driven until the cylinders 2 and 3 release the strip 12. During the first portion of such forward movement of strip 12, the printing proper occurs.

Immediately after releasing the strip 12, said strip 12 is pulled back by means of pin tractors 14 and 15, over a distance which corresponds to the difference between the just-performed forward displacement and the length of the form to be printed. The length of said form is always smaller than the circumference of that portion of the printing cylinder 2 which contacts strip 12 as said strip is being clamped.

The distance whereover the strip 12 is pulled back is thus dependent on the length of the form to be printed and said distance may be adjusted stepwise to let forms with varying length be printed with the same printing device.

Figure 2:
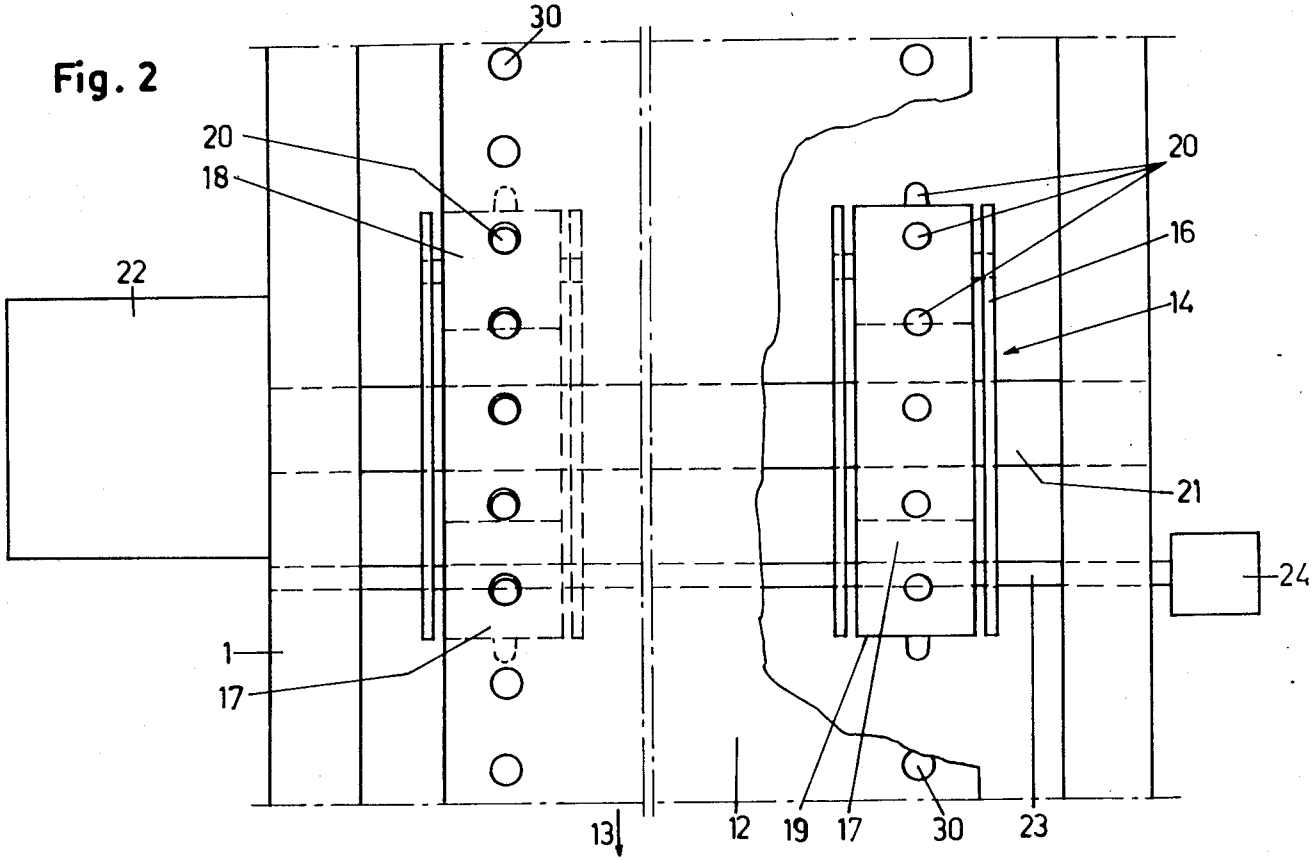
FIG. 2 is a top view of part of the device as shown in FIG. 1, but drawn on a larger scale.

As it may be deduced clearly from FIG. 2, those pins 20 which go through perforations 30 in strip 12, lie at the front in said perforations, as considered in the forward movement direction shown by arrow 13, of strip 12, during said forward displacement, but naturally they lie at the back of said perforations 30 during said latter backward movement of strip 12.

This would mean that when the cylinders 2 and 3 now clamp against the strip 12 and feed the same again forward, the position of strip 12 is not determined accurately and the pin tractors 14 and 15 can not drive directly said strip 12 positively forward. This is the reason why, before the strip 12 being gripped again between both cylinders 2 and 3, the pin tractors 14 and 15 are so moved by means of the corresponding stepping motors 22, that those pins 20 which go through perforations 30 are moved about 1 mm in the forward direction and come to lie frontwards in said perforations 30. A small displacement of strip 12 in the forward direction is possibly not excluded thereby.

In any case, the position of the strip is thereby accurately determined relative to cylinders 2 and 3 and, when said cylinders 2 and 3 clamp the strip 12 again and feed same forwards, the pin tractors 14 and 15 which are operated at the same time, also move together the strip 12 forwards. A very accurate positioning for the printing and an accurate movement of strip 12 during the printing, and thus a very accurate printing is the result thereof.

Due to such to-and-fro movement of the strip 12 during the printing, there is formed respectively in front of the printing mechanism, between rollers 25 and 40, and beyond said printing mechanism, between the rollers 29 and an additional roller 46, a loop 47,48 respectively, in the strip. In this way, the alternating movement of strip 12 during the printing has no influence on the perforating operation before the printing and on the further handling of the strip after the printing.

The size of the loops 47 and 48 and also of said loop 45 is sensed by sensors 50 which convey signals through electric lines 51, to an electronic control device 56.

Said control device 56 controls through electric lines 52, the motors 22 of pin tractors 14 and 15, and through an electric line 53, the motor 7 in such a way that the above-described driving of strip 12 is obtained.

The control device 56 also controls through lines 54 and 55, the motor 33 of the perforating device and the motor, not shown, which drives one of the rollers 38.

The control device 56 further insures that the strip is so driven that the loops 45,47 and 48 remain within determined limits.

After the printing, the strip 12 is fed to a folding mechanism with a structure known per se, wherefrom but the frame 57 and said roller 46 are shown in FIG. 1.

To make folding easier in said folding mechanism, the strip 12 is provided with perforations along the crosswise direction where it should be folded. Said perforations may already be provided in the strip before feeding to the printing device, but said printing device may also comprise a mechanism for making such crosswise perforations.

The invention is in no way limited to the above-described embodiment and within the scope of the patent application, many changes may be brought to the described embodiment, notably as regards the shape, the composition, the arrangement and the number of the components which are being used for embodying the invention.

In particular, the flattened portions of the printing cylinder and counter-pressure cylinder may be replaced by portions with a smaller diameter.

I claim:

1. A method for printing continuous forms from a printing cylinder and a counter-pressure cylinder having a printing area in excess of the area of the form to be printed, comprising:

clamping a strip to be printed, having edges with round perforations between said printing cylinder and said counter-pressure cylinder cooperating therewith from an offset printing mechanism, moving said strip forward by rotating said cylinders in opposite directions in contact with said strip and by at least one pair of pin tractors having round pins at their bases, performing printing on the strip during part of the forward movement, releasing the strip from said cylinders, moving said strip backwards by means of pin tractors over a distance which is substantially equal to the difference between the distance of said forward movement and the length of a form to be printed plus the difference in lengths of the diameters of the hole and base of the pin, driving forward the pin tractors over a small distance until their pins lie at the front in the perforations of the strip, along the displacement direction of the strip, and repeating all of the above-mentioned steps of print a subsequent form.

2. The method according to claim 1, wherein the small distance the pin tractors are driven forward during the last step is precisely equal to the difference between the diameter of the perforations in the strip and the base diameter of the pins of the pin tractors.

3. The method according to claim 1, wherein the small distance the pin tractors are driven forward during the last step is approximately equal to 1 mm.

4. The method according to claim 1, wherein the strip is driven both in the forward and backward direction by means of two pairs of pin tractors, one pair at the feed side of the printing cylinder and counter-pressure cylinder, and one pair at the discharge side of said cylinders.

5. The method according to claim 1, including forming a supply loop in the strip at the feed side of that unit formed by the cylinders and the pin tractors and forming another loop at the discharge side of said unit.

6. A device for printing continuous forms on a strip provided along both lengthwise edges with round perforations for pin tractors, which device comprises an offset printing mechanism provided with a printing cylinder, a counter-pressure cylinder cooperating therewith, and means to rotate said cylinders in opposite directions, said cylinders being arranged to move the strip forward during a part of each revolution but to release said strip during the remainder of each revolution, at least one pair of pin tractors for driving said strip, a pin tractor being arranged respectively along each edge, said pin tractors being provided with pins traversing a number of round perforations in said strip, said pins having a base diameter smaller than the diameter of said perforations, means for driving said pin tractors forwards and backwards, and a control device controlling said means for driving the pin tractors and said means for driving the cylinder so that for printing each form said cylinders and pin tractors cause a forward displacement of said strip, after which the cylinders release the strip, said pin tractors then moving the strip in the backward direction over a distance which is substantially equal to the difference between said forward displacement and the length of a form to be printed, said means for driving the pin tractors moving said pin tractors over a small distance forwards, at least until their pins lie in the forward direction in said perforations in the strip.

7. The device according to claim 6, which further comprise two pairs of pin tractors for driving the strip forwards and backwards, one pair being located at the feed side of the cylinders and one pair at the discharge side of the cylinders.

8. The device according to claim 6, which further comprises at the feed side and at the discharge side of that unit formed by the cylinders and the pin tractors, sensors for sensing a supply loop which is formed by the strip.

9. The device according to claim 6, which further comprises a device for making round perforations adjacent both edges of the strip.

10. The device according to claim 6, which further comprises a device for making round perforations adjacent both lengthwise edges of the strip, said device comprising a perforation mechanism, a smoothing-down mechanism positioned on the feeding side of the perforating mechanism and driving means to drive the strip positioned on the discharge side of the perforating mechanism.

11. The device according to claim 10, wherein the driving means comprise a pair of pin tractors and means for synchronously driving said pin tractors and perforating mechanism, and smoothing-down mechanism comprising a brush and a support surface.

* * * * *